US006490969B2

(12) United States Patent
Aichele

(10) Patent No.: US 6,490,969 B2
(45) Date of Patent: Dec. 10, 2002

(54) MACHINE FOR PRINTING OR OTHERWISE DECORATING HOLLOW BODIES

(75) Inventor: Helmut Aichele, Göppingen (DE)

(73) Assignee: Hinterkopf GmbH, Eislingen (DE)

( * ) Notice: Subject to any disclaimer, the term of this patent is extended or adjusted under 35 U.S.C. 154(b) by 0 days.

(21) Appl. No.: 09/820,779

(22) Filed: Mar. 30, 2001

(65) Prior Publication Data

US 2001/0025573 A1 Oct. 4, 2001

(51) Int. Cl.[7] ..... B41F 17/22
(52) U.S. Cl. ..... 101/37; 101/39
(58) Field of Search ..... 101/35, 36, 37, 101/38.1, 39, 40, 40.1; 118/230, 231, 232

(56) References Cited

U.S. PATENT DOCUMENTS

| | | | | | |
|---|---|---|---|---|---|
| 3,356,019 | A | | 12/1967 | Zurick | |
| 3,496,863 | A | * | 2/1970 | Cvacho et al. | 101/40 |
| 3,851,579 | A | * | 12/1974 | Zurick | 101/247 |
| 3,996,851 | A | * | 12/1976 | Urban | 101/247 |
| 4,037,530 | A | * | 7/1977 | Sirvet | 101/247 |
| 4,140,053 | A | * | 2/1979 | Skrypek et al. | 101/247 |
| 4,498,387 | A | * | 2/1985 | Stirbis | 101/40 |
| 4,750,420 | A | * | 6/1988 | Shriver | 101/40 |
| 4,821,638 | A | * | 4/1989 | Uithoven | 101/40 |
| 5,193,456 | A | * | 3/1993 | Wolfe et al. | 101/247 |

FOREIGN PATENT DOCUMENTS

| | | |
|---|---|---|
| DE | 21 43 833 | 9/1971 |
| DE | 21 43 833 A | 3/1972 |
| DE | 24 08 279 A1 | 2/1974 |
| DE | 2 408 279 A | 12/1974 |
| DE | 27 10 039 A1 | 3/1977 |
| DE | 28 26 304 A | 1/1979 |
| WO | 97/0797 | 3/1997 |
| WO | 97 07979 A | 3/1997 |
| WO | 98 56664 A | 12/1998 |

* cited by examiner

*Primary Examiner*—Daniel J. Colilla
(74) *Attorney, Agent, or Firm*—Browdy and Neimark

(57) ABSTRACT

A machine for printing on or otherwise decorating hollow bodies. It comprises a rotationally driven decoration application drum, which peripherally is provided with decoration faces, which are able to be moved along a first orbit. On an adjacent capstan plate receiving capstans are arranged for capstan units for carrying hollow bodies. On rotation of the capstan plate the radially inwardly facing sections of the hollow bodies proceed along a second orbit. Pitman units serve to so correct the second orbit on passage through a decoration zone that it coincides with the first orbit.

23 Claims, 7 Drawing Sheets

MACHINE FOR PRINTING OR OTHERWISE DECORATING HOLLOW BODIES

BACKGROUND OF THE INVENTION

The invention relates to a machine for printing or otherwise decorating hollow bodies such as sleeves, collapsible tubes, cans or the like comprising a rotationally driven decoration application drum, which is peripherally provided with one or more decoration applying faces, which on rotation of the decoration application drum proceed along a first circular orbit, a rotationally driven capstan plate whose axis of rotation is arranged athwart that of the decoration application drum, said capstan plate bearing capstan units arranged in sequence at a distance apart in its direction of rotation, said units being respectively provided with a receiving capstan, onto which capstan a hollow body to be decorated may be respectively slipped, the radially outwardly directed sections of the slipped on hollow body proceeding along a second orbit on rotation of the capstan plate, and orbit correction means, which ensure that during a passage, occurring with a simultaneous decoration operation, of a decoration zone associated with the peripheral region of the decoration application drum, the capstan units are so shifted by performing a follow-up movement directed athwart the axis of rotation of the capstan plate that the second orbit coincides with the first orbit, the capstan units being moved respectively on guide means provided on the capstan plate in the direction of the follow-up movement and being connected with cam following means which on rotation of the capstan plate run along a cam responsible for the follow-up movement.

Machines of this type, as for instance disclosed in the patent publication WO 97/07979, serve for printing or otherwise decorating hollow bodies having a round shape such as sleeves collapsible tubes, cans or the like. The term "decoration" is in the present context to mean for instance measures for lacquering, labeling, foil embossing or screen printing as well. The respective machines possess a capstan plate driven for rotation, which is provided with capstan units arranged in sequence in the direction of rotation and which possess receiving capstans, on which the hollow bodies are held. Adjacent to the capstan plate there is also a rotationally driven decoration application drum, also driven to rotate, which is provided peripherally with one or more normally segmented decoration faces—in the case of printing machines it will be a question of printing faces—which on the rotation of the decoration application drum are moved along a first circular orbit, which extends between the decoration application drum and the capstan plate.

The hollow bodies held on the receiving capstans are also moved through the decoration zone on rotation of the capstan plate. Then the radially outwardly facing sections of the so mounted hollow bodies proceed along a second orbit and in the decoration zone are brought into contact with the decoration face there at the same time. It is in this manner that it is possible for example for colored ink to be applied to the hollow bodies.

Since the two above mentioned orbits are oppositely curved, in continuous decoration methods, which are more particularly employed at high rates of production, correction of the second orbit is required in order to match its form, on its rapid passage through the decoration application zone, to the first orbit there of the first orbit. For this purpose the system of the said patent publication WO 97/07979 causes the capstan units to be guided by several guide rails so that they are able to be radially moved on the capstan plate. Simultaneously roller-like cam following means, which are pivotally mounted on a capstan support of the capstan units, engage a cam of such a shape that the capstan units perform a follow-up movement, which is athwart the axis of rotation of the spindle plate, on passage through the decoration zone, such movement matching the shape of the second orbit to that of the first orbit.

One problem occurring with the known machines of the type initially mentioned resides in the relatively high wear rate of the means provided for orbit correction of the capstan units. The forces coming into play during a decoration operation and acting on the receiving capstan give rise to a tilting moment which thrusts the cam follower rollers, arranged directly on the capstan supports, more strongly against the cam. Furthermore, heavy bending moments act on the guide rails of the capstan support. All in all this means that the accuracy of mechanical control and guidance is reduced with time and accordingly the quality of the decoration operation suffers therewith.

SHORT SUMMARY OF THE INVENTION

One object of the invention is to create a machine of the type initially mentioned in the case of which the components partaking in orbit correction are less prone to wear.

In order to achieve these and/or other objects appearing from the present specification, claims and drawings, in the present invention its inner side facing the axis of rotation of the capstan plate, of each capstan unit at a distance from the same a pivot shaft is provided which is parallel to the associated receiving capstan and is mounted for rotation as regards its longitudinal axis, said pivot shaft bearing the cam follower means at a radial distance from its longitudinal axis and on which, also at a radial distance from its longitudinal axis, has a pitman means pivoted on it, said pitman means at its other end engaging the capstan unit, so that a rotary movement caused by the cam follower means of the pivot shaft is responsible for the follow-up motion of the respective capstan unit with the aid of the pitman means.

The correction of the second orbit on motion through the decoration zone is now caused because the pivot shaft is turned through a certain angle, the torque or moment exerted being dependent on the distance between the longitudinal axis of the pivot shaft and the cam following means engaging same. The rotary movement of the pivot shaft leads to a pivotal movement of the pivot point of the pitman means so that the latter, dependent on the direction of rotation, is drawn inward or thrust outward in order to shift the associated capstan unit and to maintain the follow-up movement. In addition to the high precision thus achieved of the orbit correction there is simultaneously an effect such that the forces applied during the decoration operation do not act directly on the cam following means and the cam associated with same, but at least for a major extent are taken up by the pivot shaft and its bearing means. To the extent that a moment is exerted by the decoration forces by way of the pitman means on the pivot shaft, it is possible, by suitable matching of the working lever arms, to ensure that the resulting forces, thrusting the cam following means against the cam, are at a low level. All in all it is accordingly possible for the wear occurring on moving parts to be substantially reduced, something rendering possible high quality performance decoration even after a long working life.

Further advantageous developments of the invention are defined in the claims.

It is convenient for each capstan unit to possess an associated capstan plate bearing the associated receiving capstan by way of which the unit is rotatably supported on the capstan plate. In this case the receiving capstans may be mounted for rotation on the associated capstan plate, something which during the application of decoration allows rotation about the respective axis and accordingly free rotary movement of the hollow bodies on the capstan even if there is substantial friction between such bodies and the receiving capstans. Preferably, in this case each receiving capstan is provided with rotary drive means, with which during the decoration operation enables rotary movement to be caused, something which for example renders possible an extremely accurate development of the printed image during a printing operation.

The pitman means cooperating in the production of the follow-up movement best comprises at least two, and more particularly just two, pitman arms extending between the capstan unit and the pivot shaft, which are spaced apart in the axial direction of the pivot shaft and more especially engage the front and rear terminal parts of any capstan support present. Having such a parallel arrangement of the two pitman arms leads to a support means which is extremely dimensionally stable and capable for ensuring an accurate guiding action. The pitman arms may be respectively a component of a independent pitman unit.

In accordance with a preferred development of the invention the pitman means articulate, or have a pivotal connection, with the respectively associated capstan unit, the pivot axis extending in parallelism to the longitudinal axis of the capstan unit or coinciding with it. In the latter case it is more particularly possible to arrange for the pitman means to pivotally surround the associated capstan unit, this leading to a particularly compact overall size.

An other preferred feature of the invention is such that the bearing and guiding measures provided for rendering possible the follow-up movement of the capstan units are provided generally at the same level as the longitudinal axis of the respective receiving capstan, it being possible for each capstan unit to be secured in the direction of rotation of the capstan plate by means of support means secured to the capstan plate. Since in this case the guidance means are practically at the same level as the point of application of the decorating forces, an extremely accurate guidance is possible while substantially eliminating tilting forces. Furthermore, such measures effectively suppress vibrations.

In the case of a design whose performance quality is even further improved it is possible for the machine to be additionally provided with temporary offsetting means, by which the receiving capstans may be temporarily shifted out of their normally assumed home position in a radially inward direction into offset position so that the second orbit is spaced from the first orbit on moving through the decoration zone. This renders possible an individual offsetting or temporary shifting of the receiving capstans from the decoration application drum, if owing to some trouble condition or another cause the respective receiving capstan does not bear a correctly mounted hollow body or any body at all. Without offsetting there would be a danger of the decoration operation being performed on a naked receiving capstan. Owing to such temporary offsetting it is possible for a sufficiently large distance to be ensured in order to prevent contact between the decoration application drum and a receiving capstan.

It is convenient for the offsetting movement produced by the offsetting means to be performed by the capstan units bodily. Whereas in the case of the said patent publication WO 97/07979 a brief rotary movement of the eccentrically mounted receiving capstans meant that only such receiving capstans alone were offset, something which necessitated a separate offsetting drive, in the present invention components of the orbit correction means may also be utilized for offsetting of the receiving capstans.

In the present case the offsetting movement of the receiving capstans is preferably caused by a radial displacement of the pivot shaft. The offsetting means may, for each capstan unit, comprise an offsetting part mounted on the capstan plate for rotation about an axis parallel to the longitudinal axis of the associated receiving capstan, on which offsetting part the associated pivot shaft is eccentrically mounted for rotation with a parallel axis of rotation. Additionally provided actuating means may here cause a turning of the offsetting part in relation to the capstan plate and to the associated pivot shaft in order to position the offsetting part in two different -angular positions, in which the pivot shaft is at different distances from the axis of rotation of the capstan plate.

A particularly compact design and with a small mass to be moved is produced if the offsetting part is in each case in the form of a hollow shaft which at least partially surrounds the pivot shaft.

The angular settings of the offsetting part may be set by spring means, it being possible to employ a snap-action mechanism which ensures that one and the same spring means may set both angular positions.

In order to move the offsetting part into an angular position producing the offset position of the associated receiving capstan, an actuator may be present, which is activated by a sensor means, which is responsive to the state of the receiving capstans prior to reaching the decoration zone.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

The following description of the working example is based on a structure typical for a printing press or machine, the measures relevant for the invention being applicable to other machines for applying decoration as mentioned, as for instance machine for lacquering, labeling, embossing foil or screen printing.

Figure 1:
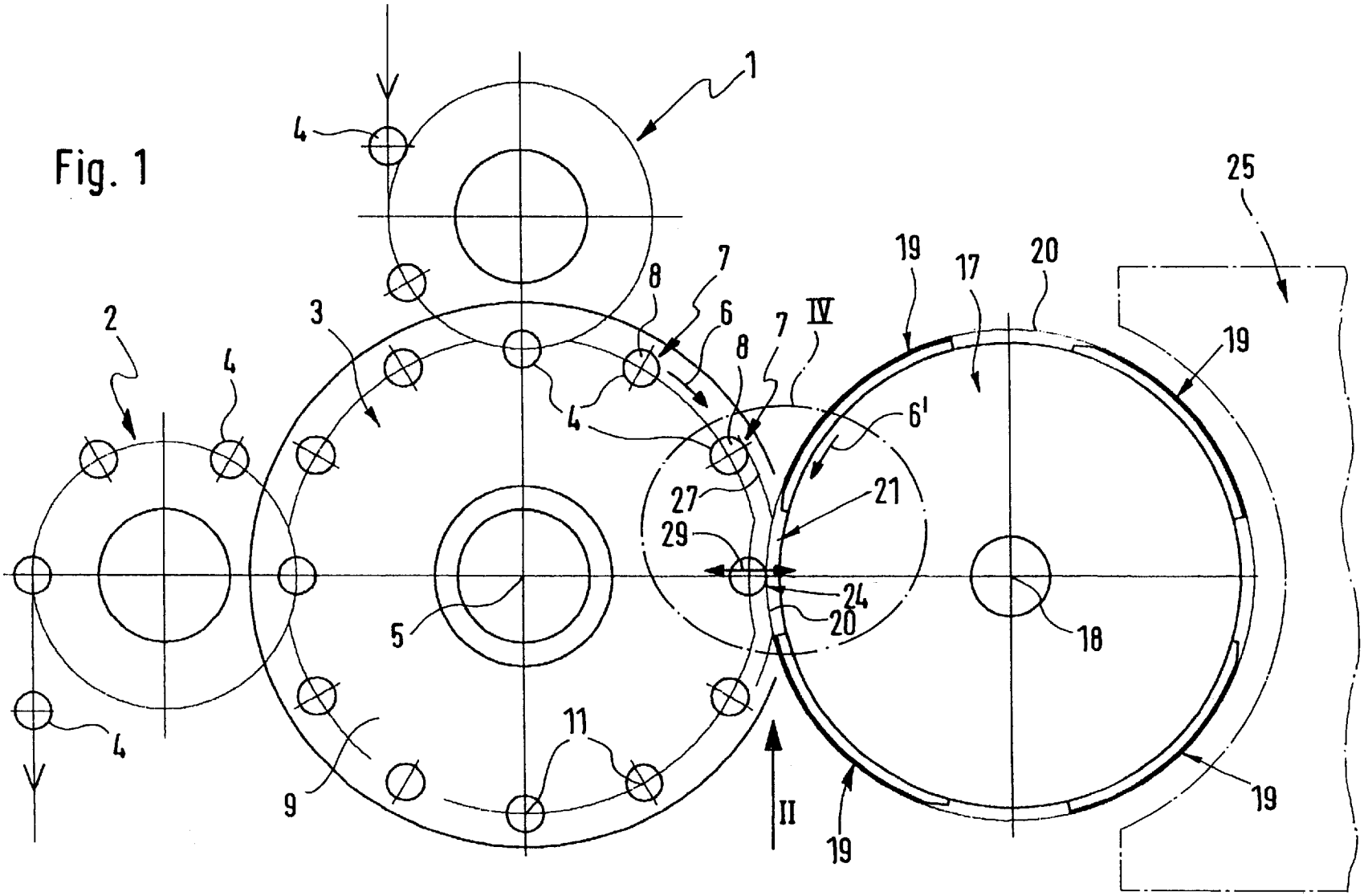
FIG. 1 shows a machine, which for example is in the form of a printing machine, for the decoration of hollow bodies in a diagrammatic fragmentary elevation looking in the axial direction of the decoration application drum and of the capstan plate.

FIG. 1 is fragmentary view of a printing press, which comprises a supply conveying means 1 and a removal conveying means 2, which are associated with the peripheral region of a rotationally driven capstan plate 3. Using the supply conveying means 1 it is possible to supply hollow bodies 4, which are to be printed on, to the capstan plate 3. Using the removal conveying means 2 hollow bodies 4 are taken over by the capstan plate 3, which have already been printed on, and cleared from the machine.

During operation the capstan plate 3 is able to be driven to perform a rotational movement about an axis 5 of rotation as indicated by the arrow, in the direction 6 of rotation. It is fitted with a multiplicity of capstan units 7 arranged in the direction 6 of rotation of the capstan plates in sequence, such units respectively comprising a receiving capstan 8 whose axis 11 of rotation is parallel to the axis 6 of rotation.

Each capstan unit 7 in this case possesses a capstan support 10, mounted for rotation on the plate-like or disk-like principal body 9 of the capstan plate 3, such support 10 bearing the associated receiving capstan 8, which is mounted for rotation at a journal section 14 in the interior of the capstan support 10 and has a receiving section 15 projecting at the front side of the capstan support 10.

Hollow bodies 4 to be printed on or to be decorated in some other way can be detachably slipped onto the receiving sections 15. Putting on is performed using the supply conveying means 1 provided suitable transfer means. In a similar way the removal of already printed hollow bodies 4 takes place using the removal conveyor means 2.

For securing the hollow body 4 seated on a receiving section 15 it is possible for suitable holding means 16 to be associated with each respective receiving capstan 8, for example operating magnetically or by vacuum. The latter possibility is the case here, the receiving capstan 8 having a vacuum duct opening at the end, which is connected with a vacuum source, not illustrated, in order to hold the mounted hollow bodies 4 by suction.

Offset in a direction athwart the axis 5 of rotation there is, adjacent to the capstan plate 3, a decoration application drum 17, which is also driven by a motor for rotation. Its axis 18 of rotation extending in parallelism with and spaced from the axis 5 of rotation of the capstan plate 3, the arrangement being such that the decoration application drum 17 and the capstan plate 3 overlap laterally and in the peripheral direction for some distance. It is in this manner that decoration faces 19, arranged peripherally on the peripheral face of the decoration application drum 17—in the present case it is a question of printing areas—assume position at the same axial level as the receiving sections 15 of the receiving capstans 8. The direction 6' of rotation as indicated by the arrow of the decoration application drum is opposite to that (6) of the capstan plate 3.

During operation of the machine the decoration faces 19 proceed along a first orbit 20 due to the rotation of the decoration application drum 17. In a decoration zone 21 associated with the transfer region between the capstan plate 3 and the decoration application drum 17—this feature is more specifically illustrated in FIGS. 3 through 7—the decoration faces 19 engage the outer periphery 24 of the respective hollow body 4 simultaneously running through the decoration zone 21 and apply the desired decoration, such decoration being by printing in the working example.

The individual decoration faces 19 are provided with decoration material by an application means 25 arranged on the periphery of the decoration application drum 17, the application means 25 in the working example being an inking unit and the decoration material being printing ink. The latter is then applied to the outer periphery of the circularly cylindrical hollow bodies 4.

In lieu of a plurality of decoration faces 19 arranged like segments on the drum's periphery it would be possible to have a single continuous decoration face.

The machine is designed for continuous decoration operations, both the decoration application drum 17 and also the capstan plates continuously rotating. The radially outwardly facing sections 26 of the hollow bodies slipped onto the receiving capstans 8 proceed along a second orbit 27. Without special measures this second orbit 27 would have a circular form, like the first orbit 20, or proceeding through the decoration zone 21, but however with the opposite curvature. However to ensure that while performing a continuous decoration operation along a prolonged path or distance, contact between the outer periphery 24 of the hollow bodies 4 and the decoration faces 19 is possible, the arrangement is such that the two orbits 20 and 27 would intersect in the case of there being a circular form, orbit correction means 28 being present, which ensure that the shape of the second orbit 27 is the same as that of the first orbit 20 on passage through the decoration zone 21.

The orbit correction is produced by driving the capstan units 7 on passage through the decoration zone 21 with the simultaneous decoration operation, to perform a follow-up movement indicated by a double arrow, which is directed athwart and more especially at a right angle to the axis 5 of rotation of the capstan plate 3 so that the respective receiving capstan 8, and with it the hollow body 4 secured thereon, perform a radial movement in relation to this axis 5 of rotation, such movement being superimposed on the circular movement about the axis 5 of rotation, such radial motion occurring in such a manner that practically the curvature of the first orbit 20 is followed and complied with.

Owing to the free running properties of the bearings of the receiving capstans 8 it is possible for the hollow bodies 4 to then roll along the decoration face 9. It is furthermore possible for the receiving capstans 8, as in the working embodiment, to be provided with rotary drive means 31, by virtue of which rotation about the capstan axis 11 can be forced to take place, at least during passage through the decoration zone 21.

In order to render the follow-up movement possible the capstan units 7 are arranged so that same may slide generally at the same level as the capstan axis 11 in the direction of the follow-up movement 9. In the working embodiment illustrated, the guide means 32 provided for this purpose comprise two bearing units 33 which are spaced from each other in the direction 6 of rotation of the capstan plate 3 and flank the capstan support 10 on opposite sides, such units 33 being secured to the principal body 9 of the capstan plate 3. On the mutually facing sides they define radially extending guide faces, with which the intermediately placed capstan support 10 is in sliding engagement for radial movement radially of the axis 5 of rotation.

In order to favor a compact design the bearing units 33 are, in the working embodiment, provided with guide faces simultaneously on both opposite faces so that they may serve for a simultaneous guiding action of two adjacent capstan supports 10. The arrangement is such that the capstan supports 10 and the bearing units 33 are arranged alternatingly in the direction 6 of rotation.

For each capstan unit 7 the orbit correction means 28 comprise a pivot shaft 34 placed on the inner face of the unit 7 facing the axis 5 of rotation of the capstan plate 3. As related to the axis 5 of rotation it is preferably placed at a distance radially within the associated capstan support 10, it extending in parallelism to the associated receiving capstan 8 and being able to rotate about its longitudinal axis 35 in relation to the principal body 9 of the capstan plate 3.

At a radial distance "a" from the longitudinal axis 35 a pitman means 36 is pivoted on the pivot shaft 34, which pitman means in the working example includes two independent pitman units 37*a* and 37*b*. Each of these pitman units 37*a* and 37*b* possesses a pitman arm 38*a* and 38*b*, which at one end is articulates at a pivot point 43 with the pivot shaft 34 at the above mentioned distance "all". The respective pivot point 43 may be defined by a pin bearing, the joint axis 44 extending in parallelism to the longitudinal axis 35 of the pivot shaft 34.

Figure 2:
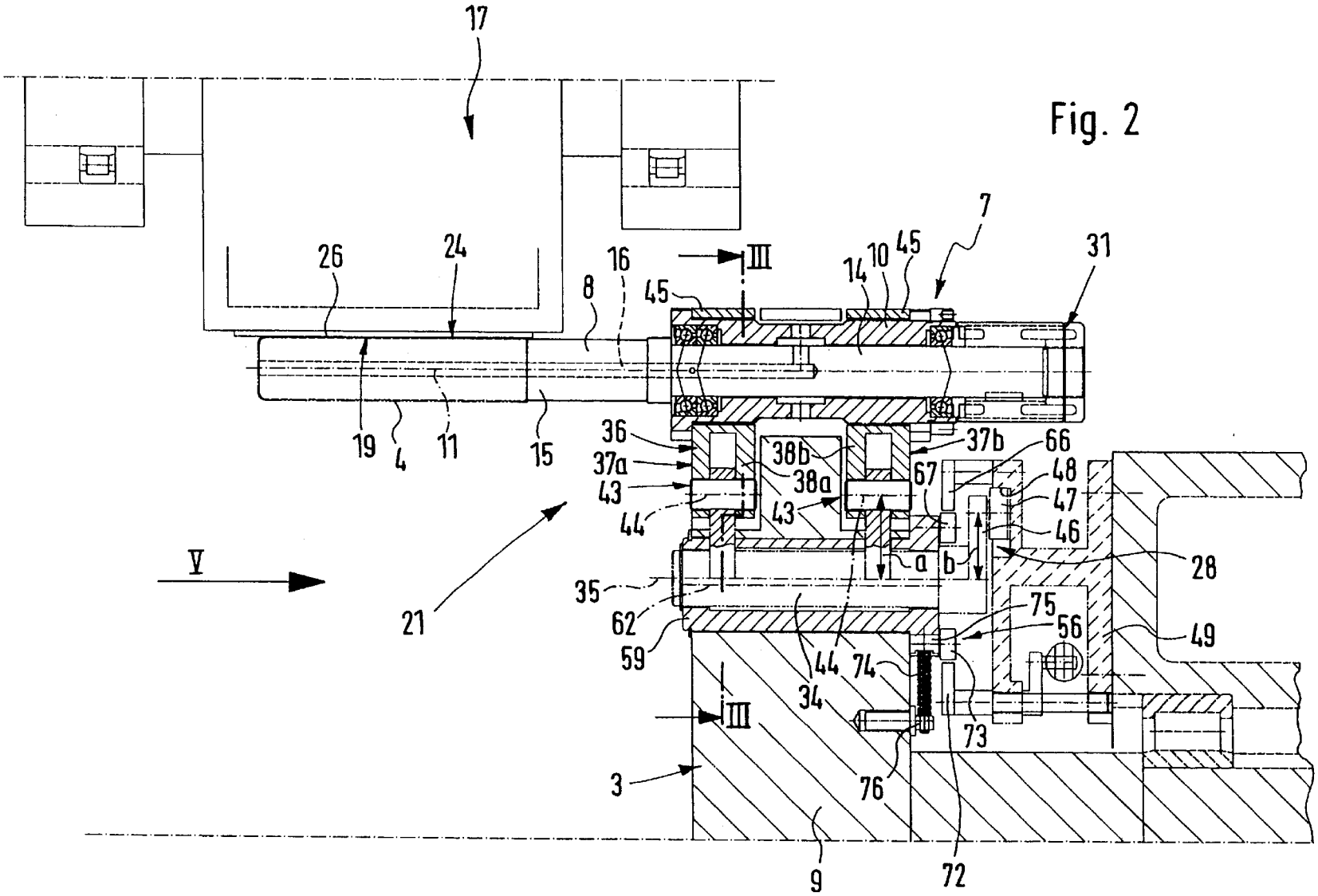
FIG. 2 is a fragmentary elevation of the machine of FIG. 2, partially sectioned, showing the decoration zone and generally as indicated by the arrow II of FIG. 1.
Figure 3:
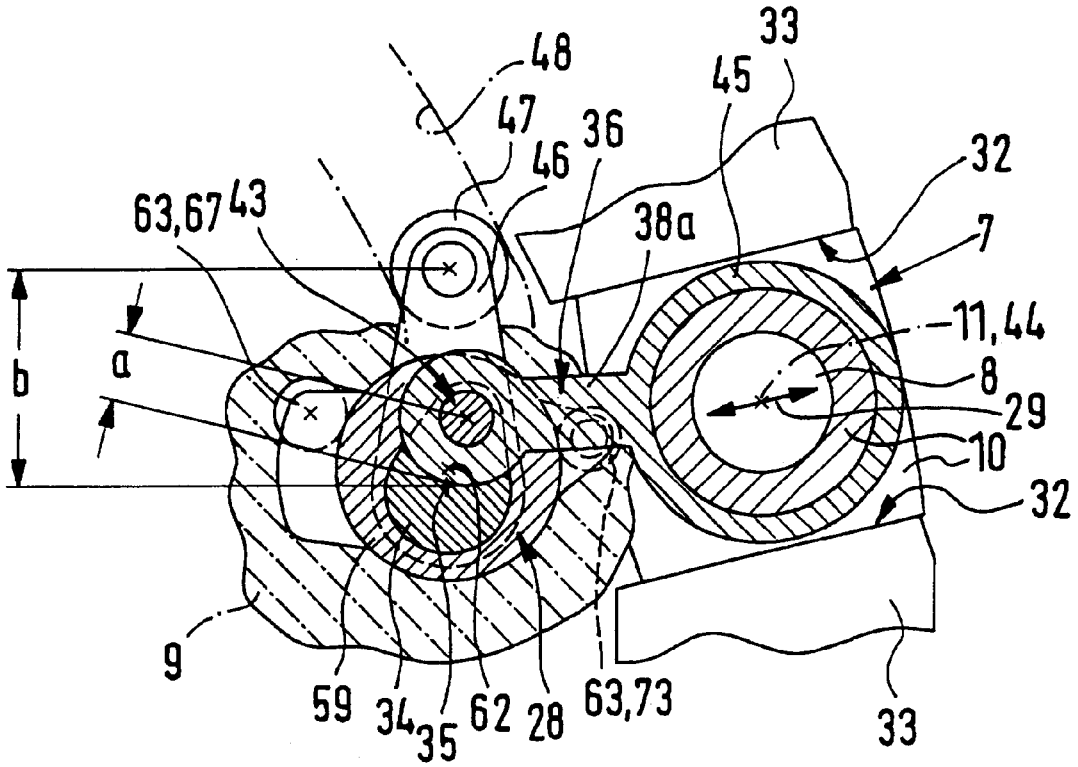
FIG. 3 is a highly diagrammatic cross section taken through the peripheral area of the capstan plate of FIG. 2 generally as indicated by the section line III—III.

In order to make the drawing more straightforward, the region with the pivot points 43 is illustrated in FIG. 2 drawn apart to an exaggerated extent. In practice the radial distance "a" is generally made relatively small, as is illustrated in FIG. 3, it being perfectly possible for the pivot point 43 to be at least partly radially within the outer periphery of the pivot shaft 34.

At the end opposite to the pivot point 43 each pitman arm 38 is pivotally mounted on the capstan unit 7 for pivotal motion in relation thereto. The pivot axis 44 thus defined may in principle extend in parallelism to and at a distance from the capstan axis 11 and for instance may be located of the inner side, facing the pivot shaft 34, of the receiving capstan 8. In order to have particularly compact dimensions the arrangement in the working example is however such that the pivot axis 44 coincides with the longitudinal axis of the capstan unit 7 or, respectively, with the capstan axis 11. This is preferably made possible by each pitman unit 37*a* and 37*b* having a bearing ring 45 coaxially surrounding the capstan support 10 at the outer end of its pitman arm 10. Said ring possesses a circular inner shape, the outer face of the capstan support 10 also being shaped circularly in the corresponding part. The design is such that each pitman unit 37*a* and 37*b* is able to be pivoted in relation to the capstan axis 11, the bearing ring 45 rotating about the capstan support 10, which is only able to be reset in the direction of the follow-up movement 29.

The two pitman units 37*a* and 37*b* and, respectively, their pitman arms 38*a* and 38*b* are conveniently so spaced apart in the axial direction of the pivot shaft 34 that they engage the front and rear terminal region of the capstan support 10. This means that the capstan units 7 are supported extremely firmly in relation to the pivot shaft 34 in a dimensionally stable manner.

A carrier arm 46 extends radially away from the pivot shaft 34. It is preferably located at one axial end region of the pivot shaft 34, and in this respect more particularly at its rear end, which is associated with the rear side, facing away from the decoration zone 21, of the principal body 9 of the capstan plate 3.

At a radial distance "b" from the longitudinal axis 35 of the pivot shaft 34, cam follower means 47 are arranged on this carrier arm 46, such means 47 preferably being constituted by rolling elements, which are rotatably mounted of the carrier arm 46 for movement about an axis of rotation parallel to the axial direction of the pivot shaft 34.

The cam follower means 47 cooperate with a stationary cam 48 constituted by a cam groove in the working example, such cam 48 being provided on a suitable cam carrier 49, which in the working embodiment is opposite to the rear side of the principal body 9 at a distance therefrom. On rotation of the capstan plate 3 the cam follower means 47 associated with the individual pivot shafts 34 run along the cam 48, which at the decoration zone 21 has a form angled toward the axis 5 of rotation so that the course departs form a circular one.

Figure 4:
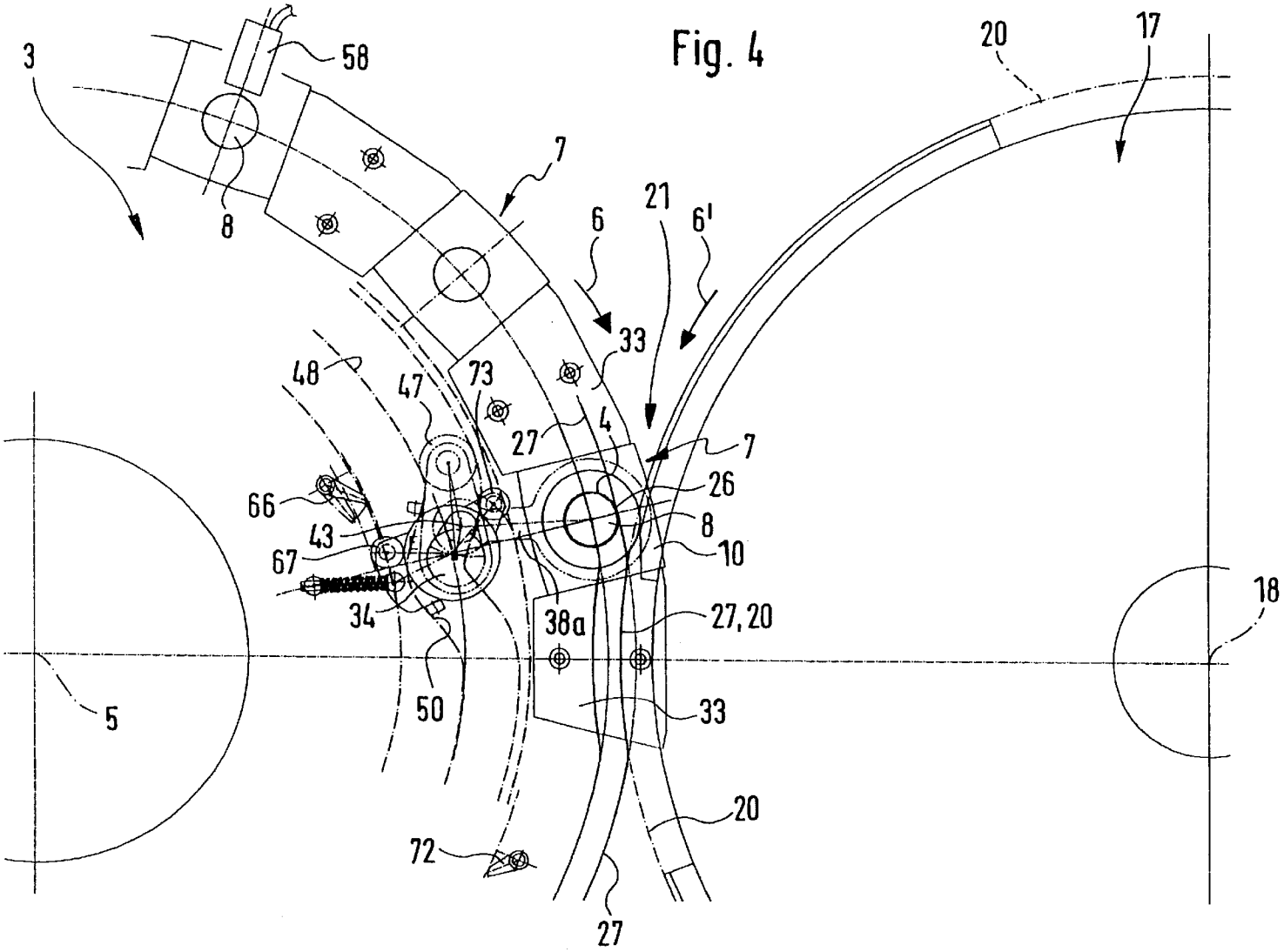
FIGS. 4 to 7 show various possible operational phases of the machine illustrated by way of example, the region indicated in FIG. 1 in chained lines generally being depicted, all in a front view and looking as indicated by the arrow V of FIG. 2.
Figure 5:
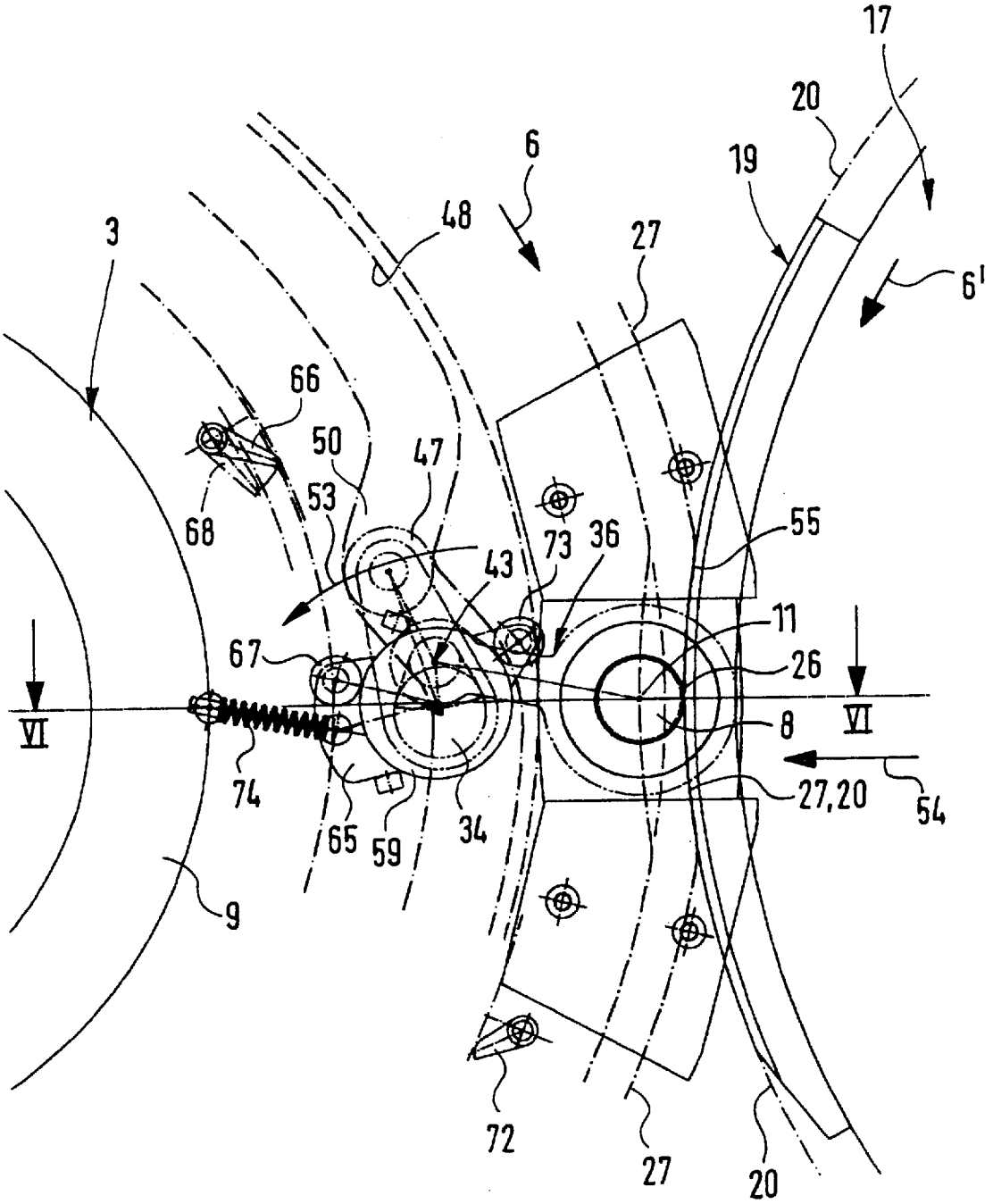

The angled course 50 or corner is matched to the curvature of the first orbit 20. As long as during rotation of the capstan plate 3 the cam follower means 47 are on a region of the cam 48 with a circular segment, the radial position of the capstan units 7 in relation to the principal body 9 will be constant. This operational phase is indicated in FIG. 4. However as soon as the cam follower means 47 come to the cam section with the angled shape 50, they will be radially shifted in accordance with the cam shape, something which owing to distance "b" from the longitudinal axis of the pivot shaft 34. will result in a pivoting of the same about the said longitudinal axis 35. The resulting angular position of the pivot shaft 34 is indicated in FIG. 5, where arrow 53 also indicates the pivoting direction.

The rotary movement of the pivot shaft 34 means that the pivot points 43 for the pitman arms 38*a* and 38*b* will be also pivoted and moved radially inward toward the axis 5 of rotation of the capstan plate. Accordingly the pitman arms 38*a* and 38*b* and with them the capstan unit 7 connected with same will be moved radially inward as indicated by the arrow 54 in FIG. 5.

Following the angled course 5 of movement each capstan unit 7 will, on moving through the decoration zone 21, be firstly drawn inward and then thrust outward so that the orbit section 55 corresponding to the decoration zone 21, of the second orbit 27 has a shape the same as that of the first orbit 20.

During a decoration operation the receiving capstans 8 and, respectively, the capstan units 7 are subjected to substantial forces, which act on the capstan units 7 in the direction 54 of the arrow. Acting by way of the toggle-like connection between the pitman means 36 and the pivot shaft 34 these forces give rise to a moment, which finally is also transmitted to the contact region between the cam follower means 47 and the cam 48. Since however the radial distance "a" is selected to be substantially smaller than the radial distance "b" a favorable leverage is obtained resulting in small pressing forces between the cam follower means 47 and the cam 48. Accordingly wear is substantially reduced. What is more, the parallel arrangement of the two pitman units 37*a* and 37*b* in conjunction with the capstan supports 10 and the pivot shaft 34 leads to a frame-like design having great dimensional stability and ensuring accurate guiding of movements by the system of bearings.

Figure 6:
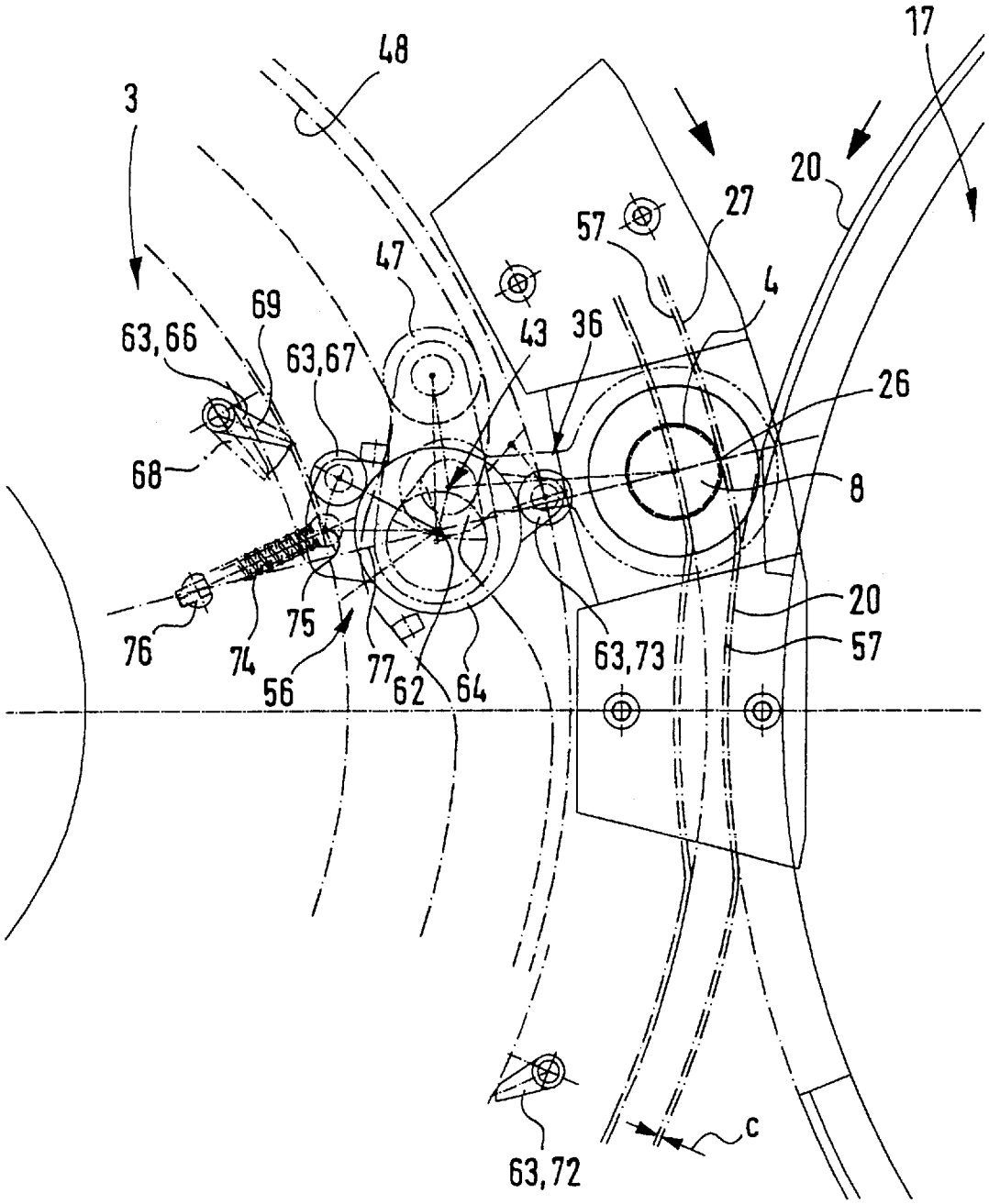
Figure 7:
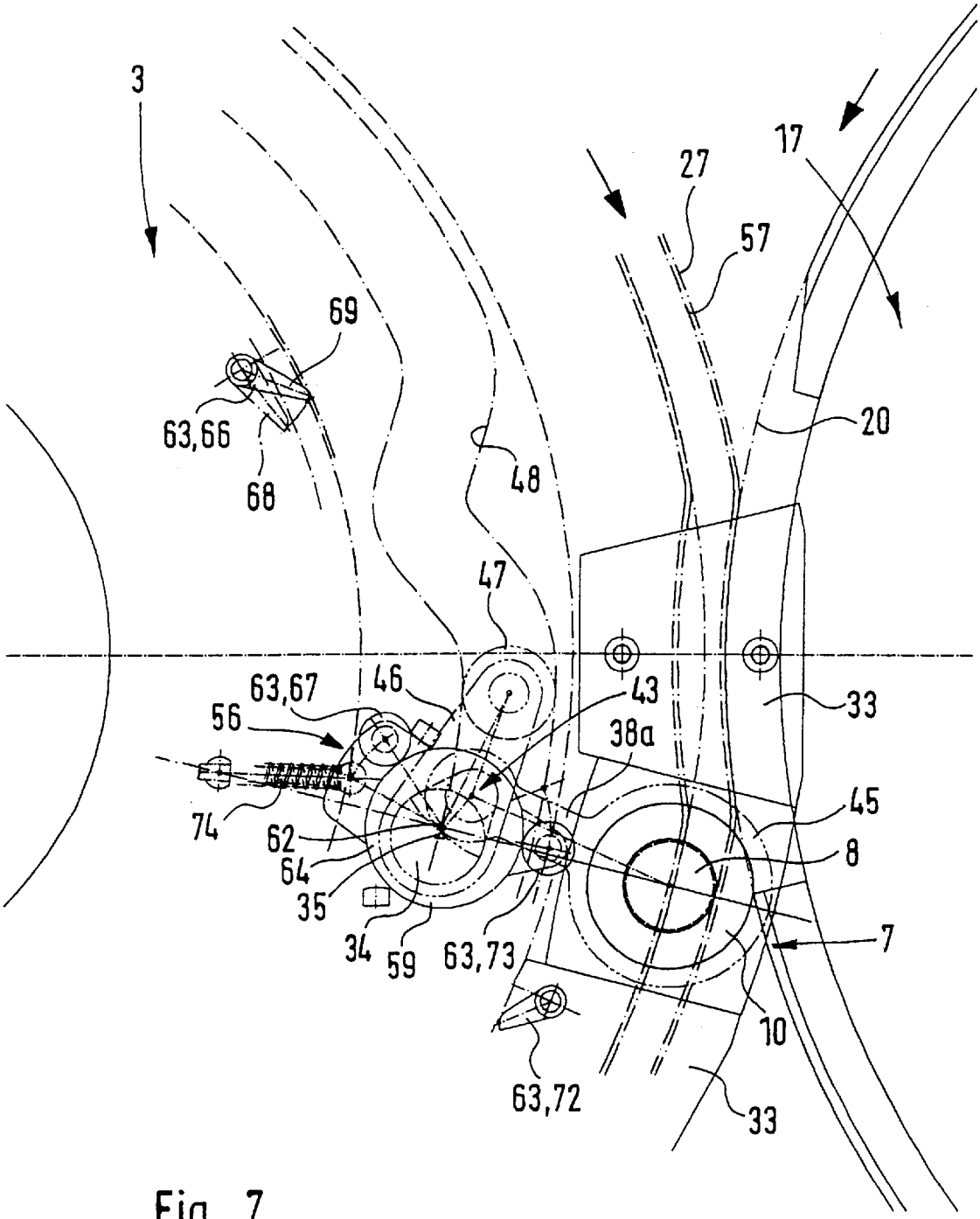

In addition to the orbit correction means 28 the machine preferably possesses offsetting means 56, which are in a position of individually shifting each individual capstan unit 7 and accordingly the receiving capstan 8 belonging thereto temporarily out of its home or normal position into an offset position appearing from FIGS. 6 and 7. Here the term home position is to be understood to be that position of the capstan units 7 which is assumed on passage along the second orbit 27. The offset position is characterized in that the capstan units 7 are shifted or displaced radially in relation to the second orbit toward the axis 5 of rotation of the capstan plate 3 so that the radially outwardly orientated sections 26 of the mounted hollow bodies 4, if present, proceed along a modified second orbit 57, which is spaced by a predetermined distance "c" from the true course of the second orbit 27 and consequently from the first orbit 20 as well. However, such offsetting is solely performed when a receiving capstan 8 is not properly carrying a hollow body 4 or does not have one at all. In order to detect the condition or status of a capstan in this respect sensor means 58 are provided, as for instance inductive proximity sensors which start the offsetting operation, when owing to the condition found no decoration operation is to be performed with respect to the particular capstan unit 7. The receiving capstan 8 is then so far offset from the decoration application drum 17 that contact with the decoration faces 19 is not possible and the receiving capstan 8 is not fouled.

The sensor means 58 are preferably located at a point, which is ahead of the decoration zone 21 in the opposite direction to the direction 6 of rotation and lies to the side of the second orbit 27. Accordingly there is sufficient time to systematically shift or offset the intended capstan unit 7 on movement through the decoration zone 21. Once the respective capstan unit 7 has passed through the decoration zone 21 it may be returned to the home position by an oppositely directed movement.

It is an advantage in the working embodiment that the offsetting movement produced by the offsetting means is performed bodily by the capstan units 7. This means that for producing the course of motion components of the orbit correction means 28 are included as well, something which leads to an economy in overall dimensions and costs.

Thus the offsetting motion of the capstan units 7 in the working example is due to a radial displacement of the pivot shaft 34. The offsetting movement is then superimposed on the rotary movement of the pivot shaft 34 responsible for the orbit correction.

Specifically, in the working embodiment the offsetting means 56 comprise an offsetting part 59 which at least partially and preferably completely surrounds the pivot shaft 34 like a tubular shaft. Each capstan unit 7 is provided with such an offsetting part 59, which is mounted in a rotatable manner on the principal body 9 of the capstan plate 3, the axis 62 of rotation 62 coinciding with its longitudinal axis and extending in parallelism to the longitudinal axis 35 of the pivot shaft 34. The latter is now mounted in a rotatable fashion in the offsetting part 59 so that its bearing function in relation to the principal body 9 is permitted indirectly by way of the intermediate offsetting part 59. Here the pivot shaft 34 is mounted in a rotatable manner eccentrically on the offsetting part 59 so that its longitudinal axis 35 extends in parallelism to the axis 62 of rotation of the offsetting part 59.

The rotational movement explained in connection with the orbit correction above of the pivot shaft 34 thus takes place in relation to the offsetting part 59 mounted in a rotatable manner of the principal body 9.

The offsetting means 56 moreover comprise actuating means 63 able to cause a turning of the offsetting part 59 about its axis 62 of rotation in relation to the principal body 9 of the capstan plate 3 and to the associated pivot shaft 34. In this case the offsetting part 59 may be selectively positioned in either of two angular settings, which are termed the offset angular setting 64 and the engaged angular setting 65 and are indicated in FIGS. 5 and 7. Owing to the eccentric mounting of the pivot shaft 34 on the offsetting part 59, the pivot-shaft 34 assumes different radial positions in relation to the axis 5 of rotation in the two angular settings 64 and 65. In the engaged angular setting 65 it is in its normal position, whereas in the offset angular setting 64 it is shifted to be nearer to the axis 5 of rotation and with it the capstan unit 7 connected in an articulating by way of the pitman means 56.

The actuating means 63 include an actuator 66 able to be switched over by the sensor means 58. It can cooperate with a first abutment 67, which keyed on the offsetting part 59 and however arranged at a radial distance from its axis 62 of rotation. In the inactive position 68, indicated in chained lines in FIGS. 5 and 6, of the actuator 66, which is arranged in a stationary manner and preferably on the cam carrier 49, the capstan plate 3 may rotate with the offsetting part 59 located in the engaged angular setting 65 without the actuator 66 acting on the first abutment 67. The orbit of the first abutment 67 extends past the actuator 66 in its inactive position 68.

Under the effect of the sensor means 58 it is possible for the actuator 66 to however be moved into an active position 69 as indicated in full lines in the drawing, more particularly owing to a pivoting movement, in which it extends into the orbit of the first abutment 67, when the associated offsetting part 59 assumes the engaged angular setting 65. Thus the first abutment 67 strikes the actuator 66 and is turned into the offset angular setting 64, which is indicated in FIGS. 6 and 7.

The offset setting, associated therewith, of the associated capstan unit 7 is dwelled in until on passage through the decoration zone 21 a return means 72, also considered as a part of the actuating means 63, becomes effective. Such return means 72 extends into the orbit of a second abutment 73 when the offset part 59 is in the offset angular setting 64, which abutment 73, like the first abutment 67 is arranged at a radial distance from the axis of rotation of the offsetting part 59. As a consequence the offsetting part 59 is turned back into the engaged angular setting 65 again.

FIGS. 6 and 7 show the offset setting or position of a capstan unit 7 with the offsetting part 59 in the offset angular setting 64. In this case FIG. 7 shows a phase, in which the decoration zone 21 is just being left and the second abutment 73 is just about to run onto the return means 72 ahead of it. The return means is also arranged in a stationary fashion and is more specially located on the cam carrier 49, it being able to assume an invariable position.

The two angular settings 64 and 65 of the offset part 59 are preferably temporarily set by spring means 74. On the one hand such spring means 74 engage the offsetting part 59 (point of engagement 75) with a radial distance from the axis 62 of rotation and at the other end bear against a bearing point 76 on the principal body 9. In this case the point 75 of engagement is in the two angular settings 64 and 65 on opposite sides of an imaginary line 77 connecting the bearing point 76 and the axis 62 of rotation of the offsetting part 59. This leads to snap action effective, the offsetting part 59 being held by spring force in both angular settings 64 and 65 while however being able to be turned if the spring force is overridden, the spring means 74 being rocked about the bearing point 76.

What is claimed is:

1. A machine for printing or otherwise decorating hollow bodies such as sleeves, collapsible tubes, cans or the like comprising a rotationally driven decoration application drum, which is peripherally provided with one or more decoration applying faces, which on rotation of the decoration application drum proceed along a first circular orbit, a rotationally driven capstan plate whose axis of rotation is arranged parallel to that of the decoration application drum, said capstan plate bearing capstan units arranged in sequence at a distance apart in its direction of rotation, said units being respectively provided with a receiving capstan, onto which capstan a hollow body to be decorated may be respectively slipped, the radially outwardly direction sections of the slipped on hollow body proceeding along a second orbit on rotation of the capstan plate, and orbit correction means, which ensure that during a passage, occurring with a simultaneous decoration operation, of a decoration zone associated with the peripheral region of the decoration application drum, the capstan units are so shifted by performing a follow-up movement directed athwart the axis of rotation of the capstan plate that the second orbit coincides with the first orbit, the capstan units being moved respectively on guide means provided on the capstan plate in the direction of the follow-up movement and being connected with cam following means which on rotation of the capstan plate run along a cam responsible for the follow-up movement, wherein on its inner side, facing the axis of rotation of the capstan plate, of each capstan unit at a distance from the same a pivot shaft is provided which is parallel to the associated receiving capstan and is mounted for rotation as regards its longitudinal axis, said pivot shaft bearing the cam follower means at a radial distance from its longitudinal axis and on which, also at a radial distance from its longitudinal axis, has a pitman means pivoted on it, said pitman means at its other end engaging the capstan unit, so that a rotary movement caused by the cam follower means of the pivot shaft is responsible for the follow-up motion of the respective capstan unit with the aid of the pitman means.

2. The machine as set forth in claim 1, wherein each capstan unit possesses a capstan support bearing the associated receiving capstan, same serving for mounting it on the capstan plate in a rotatable manner.

3. The machine as set forth in claim 2, wherein the receiving capstans are mounted in a rotatable fashion on the associated capstan support.

4. The machine as set forth in claim 3, wherein each receiving capstan is provided with rotary driving means for producing a forced rotary movement thereof about its longitudinal axis at least on passage through the decoration zone.

5. The machine as set forth in claim 1, wherein the pitman means respectively include at least two pitman arms extending between the capstan unit and the pivot shaft, such arms being spaced apart in the axial direction of the pivot shaft.

6. The machine as set forth in claim 5, wherein the pitman means includes two such pitman arms, adapted to engage front and rear terminal regions of a capstan support bearing the receiving capstan, on whose front side a receiving section serving to receive a hollow body of the receiving capstan outwardly extends.

7. The machine as set forth in claim 5, wherein the pitman arms are each a component of an independent pitman unit engaging the capstan unit and the pivot shaft.

8. The machine as set forth in claim 1, wherein the pitman means are in engagement with the respectively associated capstan unit to allow pivotal motion in relation to it, the pivot axis extending in parallelism to the axis of the capstan unit or coinciding with same.

9. The machine as set forth in claim 8, wherein the pitman means pivotally surround the associated capstan unit at a capstan support bearing the receiving capstan.

10. The machine as set forth in claim 1, wherein generally at the level of the longitudinal axis of their receiving capstans the capstan units are guided for sliding movement in the direction of the follow-up movement.

11. The machine as set forth in claim 10, wherein adjacent to the capstan support bearing the receiving capstan each capstan unit is flanked in the direction of rotation of the capstan plate on either side by bearing units fixed to the capstan plate, which capstan unit is responsible for bearing the capstan units for sliding movement in the direction out of the follow-up movement.

12. The machine as set forth in claim 1, wherein the cam following means are associated with an axial terminal region of the pivot shaft.

13. The machine of claim 12 wherein the cam following means comprise rolling elements.

14. The machine as set forth in claim 1, wherein the cam following means are arranged on the carrier arm extending radially from the pivot shaft.

15. The machine as set forth in claim 1, comprising offsetting means, which are able to shift the receiving capstans temporarily out of their home position radially inwardly into an offset or shifted position so that the second orbit extends at a distance from the first orbit on passage through the decoration zone.

16. The machine as set forth in claim 15, wherein the offsetting means of the capstan units is adapted to move the entire capstan unit.

17. The machine as set forth in claim 15, wherein the offsetting movement of the receiving capstans is caused by a radial displacement of the pivot shaft.

18. The machine as set forth in claim 17, wherein the offsetting means for each capstan unit comprise an offsetting part rotatably mounted on the capstan plate for turning about an axis of rotation parallel to the longitudinal axis of the associated receiving capstan, said offsetting part having an associated pivot shaft rotatably mounted eccentrically to said axis of rotation, actuating means being provided, which are able to produce a turning motion of the offsetting part in relation to the capstan plate and to the associated pivot shaft in order to position the offsetting part in two different angular settings in which the pivot shaft is differently spaced from the axis of rotation of the capstan plate.

19. The machine as set forth in claim 18, wherein the offsetting part is designed in the form of a hollow shaft and at least partly surrounds the pivot shaft.

20. The machine as set forth in claim 18, wherein the offsetting part is fixed in the two angular settings by spring means.

21. The machine as set forth in claim 18, wherein the actuating means comprise an actuator able to be switched over between an inactive and an active position, which actuator in the active position thereof projects into the orbit of an abutment keyed on the offsetting part and arranged at a radial distance from the axis of rotation thereof in order on the impingement thereof to alter the angular setting of the offsetting part for the purpose of displacement of the associated receiving capstan into the shifted or offset setting.

22. The machine of claim 21 wherein said actuator is sensor operated.

23. The machine as set forth in claim 18, wherein the actuating means include a return means, which with a receiving capstan in the offset position, projects into the orbit of an abutment which is locked in rotation with the offsetting part at a radial distance from its axis of rotation in order, on impingement, of the latter, to alter the angular setting of the offsetting part for the purpose of returning the associated receiving capstan into the home position thereof.

* * * * *